US011614760B2

(12) United States Patent
Liang et al.

(10) Patent No.: US 11,614,760 B2
(45) **Date of Patent: *Mar. 28, 2023**

(54) BIASING SCHEME FOR POWER AMPLIFIERS

(71) Applicant: SKYWORKS SOLUTIONS, INC., Irvine, CA (US)

(72) Inventors: Bang Li Liang, Ottawa (CA); Yasser Khairat Soliman, Kanata (CA); Adrian John Bergsma, Ottawa (CA); Haoran Yu, Ottawa (CA); Hassan Sarbishaei, Ottawa (CA)

(73) Assignee: Skyworks Solutions, Inc., Woburn, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/668,681

(22) Filed: Feb. 10, 2022

(65) Prior Publication Data

US 2022/0253081 A1 Aug. 11, 2022

Related U.S. Application Data

(63) Continuation of application No. 16/802,175, filed on Feb. 26, 2020, now Pat. No. 11,281,247.

(60) Provisional application No. 62/810,770, filed on Feb. 26, 2019.

(51) Int. Cl.

| | |
|---|---|
| ***G05F 1/56*** | (2006.01) |
| ***G05F 1/565*** | (2006.01) |
| ***G05F 1/575*** | (2006.01) |
| ***G05F 1/46*** | (2006.01) |

(52) U.S. Cl.

CPC ..... *G05F 1/565* (2013.01); *G05F 1/461* (2013.01); *G05F 1/468* (2013.01); *G05F 1/575* (2013.01)

(58) Field of Classification Search

CPC ..... G05F 1/565; G05F 1/461; G05F 1/468; G05F 1/575

See application file for complete search history.

(56) References Cited

U.S. PATENT DOCUMENTS

| | | | | |
|---|---|---|---|---|
| 2012/0098606 | A1* | 4/2012 | Yagasaki | H03F 3/245 330/253 |
| 2019/0302817 | A1* | 10/2019 | Rosolowski | H02M 3/07 |
| 2020/0091608 | A1* | 3/2020 | Alpman | H03L 7/145 |
| 2021/0072778 | A1* | 3/2021 | Chao | G05F 1/618 |

* cited by examiner

*Primary Examiner* — Kyle J Moody
*Assistant Examiner* — Lakaisha Jackson
(74) *Attorney, Agent, or Firm* — Chang & Hale LLP

(57) ABSTRACT

A front-end module comprises a low-dropout (LDO) voltage regulator, a reference current generator, and a power amplifier. The LDO voltage regulator, reference current generator, and power amplifier are integrated on a first semiconductor die.

20 Claims, 9 Drawing Sheets

300

BIASING SCHEME FOR POWER AMPLIFIERS

CROSS-REFERENCE TO RELATED APPLICATION

This application is a continuation of U.S. application Ser. No. 16/802,175 filed Feb. 26, 2020 and entitled "BIASING SCHEME FOR POWER AMPLIFIERS," which claims priority to U.S. Provisional Application No. 62/810,770 filed Feb. 26, 2019, entitled "BIASING SCHEME FOR POWER AMPLIFIERS," each of which is expressly incorporated by reference herein in its entirety for all purposes.

BACKGROUND

Field

The present disclosure relates to power amplifier circuits, related devices, and related methods for radio-frequency (RF) applications.

Description of the Related Art

Some power amplifier circuits include integrated duplex filters. Often, duplex filters and/or other components of power amplifier circuits can be sensitive to damage from various factors such as process variation and temperature in such a way as to decrease the overall performance of the circuit.

SUMMARY

In accordance with some implementations, the present disclosure relates to a front-end module comprising a low-dropout (LDO) voltage regulator, a reference current generator, a power amplifier, and a voltage reference configured to provide a reference voltage to the LDO voltage regulator and the reference current generator. The LDO voltage regulator, reference current generator, power amplifier, and voltage reference are integrated on a first semiconductor die.

In some embodiments, the voltage reference is a bandgap voltage reference. The power amplifier may be a Silicon-On-Insulator (SOI) complementary metal-oxide-semiconductor (CMOS) power amplifier. In some embodiments, the power amplifier is configured to provide an output power of at least 22 dBm. The power amplifier may include an n-channel metal-oxide field-effect transistor (NMOSFET). In some embodiments, the LDO voltage regulator is configured to be turned off in sleep mode.

The front-end module may further comprise a mode detector configured to generate a power-down signal to power down the LDO voltage regulator. In some embodiments, the mode detector is a direct current (DC) mode detector operating at less than 50 nA. The mode detector may be configured to be maintained in an always-alive state. In some embodiments, the front-end module further comprises a supply generator configured to power the mode detector. The supply generator may be configured to operate at less than 50 nA and is configured to be maintained in an always-alive state. In some embodiments, the power amplifier is configured to operate at a first level during transmit modes and operate at a second level during non-transmit modes.

In some teachings, the present disclosure relates to a semiconductor die comprising a substrate, an LDO voltage regulator, a reference current generator, a power amplifier, and a voltage reference configured to provide a reference voltage to the LDO voltage regulator and the reference current generator.

In some embodiments, the voltage reference is a bandgap voltage reference. The power amplifier may be an SOI CMOS power amplifier. In some embodiments, the LDO voltage regulator is configured to be turned off in sleep mode. The semiconductor die may further comprise a mode detector configured to generate a power-down signal to power down the LDO voltage regulator. In some embodiments, the mode detector is configured to be maintained in an always-alive state. The front-end module may further comprise a supply generator configured to power the mode detector. In some embodiments, the power amplifier is configured to operate at a first level during transmit modes and operate at a second level during non-transmit modes.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DESCRIPTION

Figure 1:
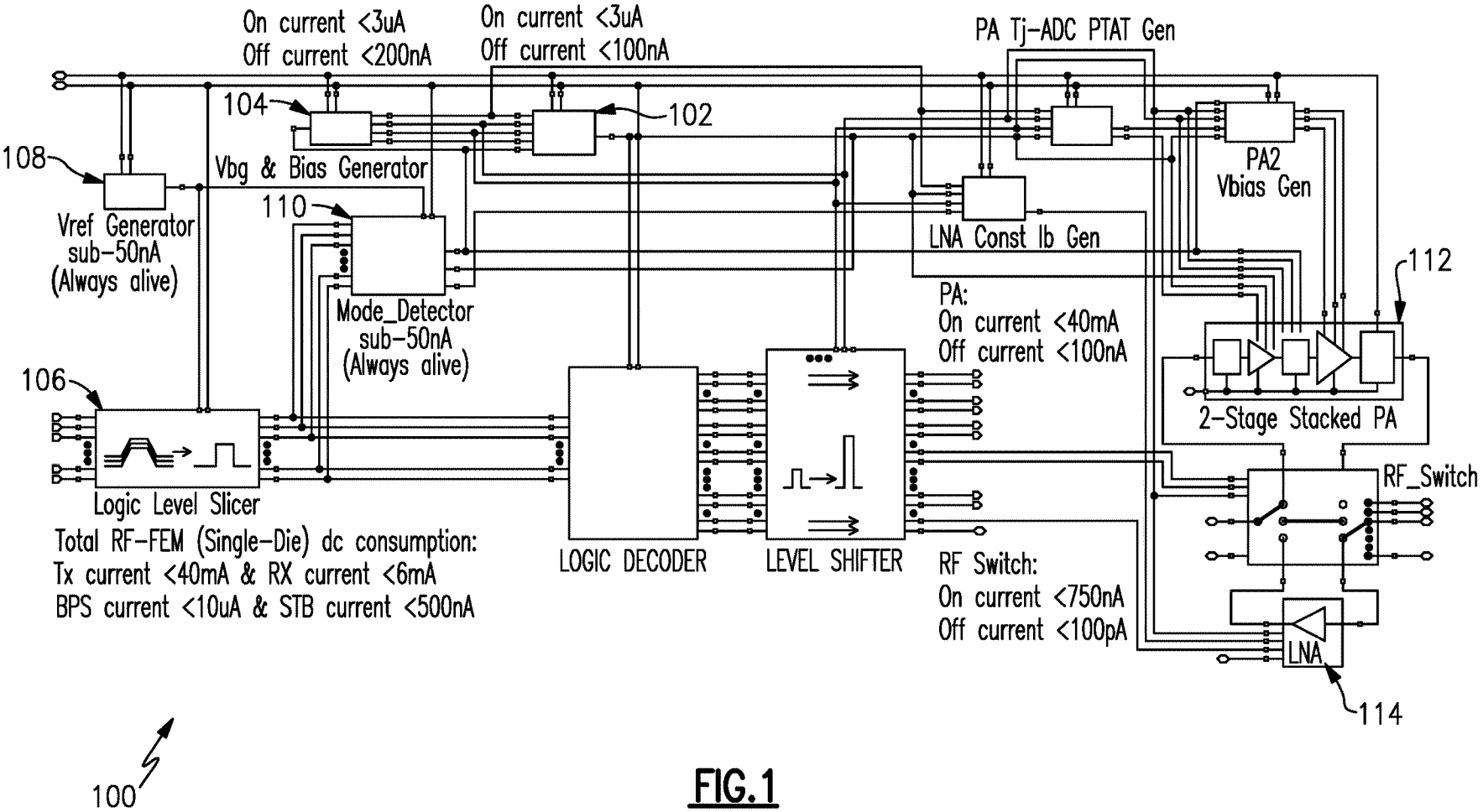
FIG. 1 depicts a block diagram of a monolithic integrated SOI CMOS radio frequency front-end module having one or more features as described herein.

The headings provided herein, if any, are for convenience only and do not necessarily affect the scope or meaning of the claimed invention.

Some high-performance and/or highly-integrated radio frequency front-end modules (FEMs) designed for high-power Industrial, Scientific, Medical (ISM) band applications may be configured to operate in the 860 to 930 MHz frequency range. To support such designs, a radio frequency front-end module may integrate a power amplifier with relatively high output power (e.g., +22 dBm), relatively low loss (e.g., less than 1.0 dB), a relatively low power transmit bypass path (e.g., a radio frequency switch and/or antenna switch), and/or a low-noise amplifier (LNA) (e.g., having a noise figure of approximately 1.5 dB) into a single Silicon-On-Insulator (SOI) complementary metal-oxide-semiconductor (CMOS) die. Integrating such designs on a single semiconductor die can support wide-band operations and/or single-ended (e.g., 50 Ω) transmit/receive radio frequency interfaces.

High-performance front-end modules may be configured to provide and/or may require a variety of specifications, which may include, among others: wide-supply voltage ranges (e.g., 2.0 V to 5 V) and/or temperature ranges (e.g., −40° C. to 125° C.); digital controls compatible with various CMOS levels (e.g., 1.2 V to 5 V); relatively fast turn-on/turn-off times (e.g., less than 5 μSec); relatively low transmit bypass path loss (e.g., less than 1.0 dB); a low transmit bypass path current (e.g., less than 10 μA); low sleep-mode current (e.g., less than 1 μA); high power amplifier output power (e.g., greater than 22 dBm) and superior gain flatness (e.g., less than 1 dB from −40° C. to 125° C.); low quiescent current variation over PVT; and/or small die area consumption (e.g., less than 1.5 $mm^2$).

To meet the above specifications, embodiments described herein may provide radio frequency front-end module architectures configured to perform a variety of functions. In one use case, a front-end module architecture may be configured to provide a high-quality, noise-insensitive, and/or radio frequency coupling-insensitive bandgap voltage reference and/or a relatively very robust low-dropout (LDO) voltage regulator (e.g., operating in a 2.0 V to 5.0 V supply voltage range) with loading current (e.g., from sub-μA to approximately 200 mA) to support various transmit modes (e.g., 25 mA to 180 mA), receive modes (e.g., 5 mA to 40 mA), bypass modes (e.g., less than 10 μA), and/or sleep modes (e.g., less than 1 μA). Moreover, the architectures described herein may be configured to allow a bandgap voltage and/or an LDO voltage to startup and/or shut down quickly during mode transition.

In another use case, a front-end module architecture may be configured to provide a relatively low-power (e.g., less than 100 nA) and/or less-regulated supply for a control logic decoder, level slicer, and/or level convertors to support digital control logic compatibility with various CMOS levels (e.g., 1.2 V to 5 V). In some embodiments, some components of the architecture may be configured to be constantly maintained in an awake state (e.g., greater than 1 μA).

Some embodiments herein may provide low-loss (e.g., less than 1 dB) and fast turn-on/turn-off time transmit bypass paths, which may include RF switch(es) and/or antenna switch(es) powered by an LDO voltage. A front-end module architecture may utilize high-performance low-voltage SOI technology to establish a tradeoff between power handling and switching speed. Low-power circuitry may be used to support low-power (e.g., less than 10 μA) transmit bypass modes. In some embodiments, low-insertion loss switch(es) and/or control logic level convertors may be configured to operate under LDO over wide supply voltage ranges. In one use case, a sum of a direct current (DC) value from a bandgap (e.g., LDO) voltage and a leakage current from control logic level convertors and switches may be limited within 10 μA without sacrificing startup time from sleep mode to other active modes.

Some embodiments may support low sleep currents (e.g., less than 1 μA) by providing for shutting down high-power radio frequency blocks (e.g., power amplifier and LNA), bandgap, and/or LDO to improve system efficiency. Moreover, some embodiments may involve confining current consumption of various blocks (e.g., always-alive blocks, including switches, less-regulated supplies, control logic decoders, level slicers, and/or level convertors) and/or leakage current from output stages of the power amplifier which may be powered by battery and/or external power supply directly within, for example, 1 μA.

In some embodiments, an on-die power amplifier (e.g., an SOI CMOS power amplifier) may be configured to provide relatively high output power (e.g., greater than 22 dBm) and/or may be configured to operate reliably over wide supply voltage ranges. Some embodiments may utilize relatively large amplifiers (e.g., n-channel metal-oxide field-effect transistors (NMOSFETs)) to provide relatively high current handling, relatively high voltage handling (e.g., through use of stacked amplifier topology), relatively high power amplifier efficiency (e.g., through biasing), superior gain flatness (e.g., less than 1 dB) over frequency bands and wide-operating temperature ranges (e.g., −40° C. to 125° C.), low power-down leakage current, and/or high shut-down mode reliability. Moreover, some embodiments may be configured to provide fast turn-on/turn-off of various components (e.g., an LNA and/or power amplifier). Because there is a tradeoff between turn-on/turn-off times, leakage current, and die area, some embodiments may be configured for use with limited die area.

Usage of bandgap voltage references and/or LDO regulators may consume large die area and extensive resources (e.g., tens of μA of DC current). For example, bandgap voltage references and/or LDO regulators may be required to turn off in sleep mode, however a power-down signal may be difficult to generate without a power-down pin. Moreover, the power-down signal may not be easily controlled if the supply voltage varies (e.g., from 2 V to 5 V). However, because supply voltage levels from voltage dividers may be less regulated, controllers using simple voltage dividers may suffer from poor power supply rejection ratio (PSRR) and/or supply voltage-dependent output voltage and/or may be limited to relatively narrow supply voltage range applications. Some embodiments described herein may advantageously support wide power supply ranges (e.g., 2 V to 5 V) with reasonable PSRR. Embodiments may further provide low sleep-mode current specifications by implementing a low leakage current (e.g., less than 100 nA) LDO regulator that may be turned off in sleep mode.

Maintaining controllers at always-alive levels when no external power-down pin is available may require all blocks within a radio frequency front-end module to have a very low-power design. In some cases, it may be difficult or impossible to meet extremely low leakage current specifications. Some embodiments described herein may advantageously involve generating a power-down signal from input control signals using a relatively low DC current (e.g., less than 50 nA) mode detector to power down the bandgap voltage reference and/or LDO regulator (which may supply current for all control signal path circuitry, an LNA, and/or a first stage of the power amplifier). The mode detector may be maintained in an always-alive state so that any operating mode changes can be detected quickly (e.g., without requiring a wake up stage). Moreover, the mode detector may be powered by a low-power (e.g., less than 50 nA) less-regulated supply generator, which may advantageously also be configured to be maintained in an always-alive state.

Moreover, to provide well-regulated supply levels for level shifters and/or logic decoders, various components may be implemented. For example, radio frequency switches, antenna switches, and/or high-threshold voltage devices (e.g., 5 V bulk CMOS and/or 5 V silicon-germanium (SiGe) bipolar junction CMOS (BiCMOS) processes) may be used to reduce leakage current, simplify level convertor design, remove one or more level clippers, and/or increase reliability over a wide supply range. However, such solutions may require multiple dies and/or may result in higher cost and design complexity. Some embodiments described herein may advantageously implement a low-power bandgap voltage reference to provide a reference voltage (e.g., approximately 0.835 V) to an LDO regulator and/or power amplifier. The low-power bandgap voltage reference may further provide LNA reference current generators, which may be able to operate well over wide-supply voltage ranges (e.g., 2 V to 5 V) and/or may be configured to be shut down in sleep mode with relatively low leakage current (e.g., less than 200 nA).

To achieve efficient radio frequency performance, a power amplifier may be implemented in an SiGe BiCMOS and/or a gallium arsenide (GaAs) heterojunction bipolar transistor (HBT) using a proportional to absolute temperature (PTAT) reference current, a complementary to absolute temperature (CTAT) reference current, and/or a combination (e.g., PTAT+/−CTAT) reference current generator for sufficiently small signal gain flatness. However, such designs may be relatively expensive. Moreover, multi-die solutions may result in greater die area, more complex die-to-die connections and/or packaging, and/or difficult top-level simulation, each of which may cause increased cost and/or design complexity. Some embodiments described herein advantageously provide reliable DC bias and/or gain flatness (e.g., less than 1 dB) over wide temperature ranges (e.g., −40° C. to 125° C.) for a CMOS power amplifier. Moreover, some embodiments may provide a bias network with a superior small-signal gain temperature compensation scheme utilizing on-die junction temperature sensors, n-bit analog-to-digital convertors, and/or n-bit PTAT current source banks to set proper reference current levels for various operating temperature regions (e.g., $2^n$+2 regions) automatically without undesired electrical feedback loops. In this way, the power amplifier may be configured to operate with high power-added efficiency (PAE) and superior gain flatness in transmit modes and/or low leakage current and/or high reliability when the power amplifier is disabled.

Some embodiments involve power amplifier biasing schemes utilizing higher-order temperature compensation, junction temperature sensing, and/or automatic operating temperature region selection. Such biasing schemes may provide effective gain flatness over wide operating temperature ranges (e.g., −40° C. to 125° C.). Some embodiments may involve on-die junction temperature sensors, n-bit analog-to-digital convertors, and/or n-bit PTAT current source banks to set proper reference current levels for various operating temperature regions (e.g., $2^n$+2 regions) automatically without undesired electrical feedback loops. Moreover, some embodiments may involve a hybrid bias current topology of constant current generators (e.g., proportional to square of temperature (PTAT2) or similar generators), which may be configured to generate large quiescent current variation over process, voltage, and temperature (PVT).

FIG. 1 depicts a block diagram of a monolithic integrated SOI CMOS radio frequency front-end module 100 having one or more features as described herein. In some embodiments, the front-end module 100 may be powered by an on-die LDO regulator 102 for wide-supply voltage compliance and sufficient PSRR for analog functional blocks. A voltage level clipper may be built into a logic level slicer 106 that may be configured to convert various standard logic levels (e.g., CMOS, transistor-transistor logic (TTL), low-voltage differential signaling (LVDS), current-mode logic (CML), low-voltage positive emitter-coupled logic (LVPECL), etc.) from 1.2 V to 5 V into a single 1.5 V logic level for wide logic level compliance. A reference voltage ("Vref") generator 108 may be configured to provide a regulated supply voltage (e.g., approximately 1.5 V) for digital blocks (which may include a mode detector 110, voltage level clipper, and/or logic level slicer 106) and may be maintained in an always-alive state. The front-end module 100 may further comprise a bandgap voltage (Vbg) generator 104. In some embodiments, the reference voltage generator 108, Vbg generator 104, and/or LDO regulator 102 may provide a clean reference voltage (e.g., a Vbg of approximately 0.835 V) and a well-regulated internal supply regulated voltage ("Vreg") for control logic decoders, logic level convertors, bias current/voltage generators for one or more LNAs 114, radio frequency switches, and first stage power amplifiers. A constant reference current generator may be used for LNA biasing. A varying slope (e.g., varying with temperature) reference current may be used for a 2-stage power amplifier 112 to achieve sub-1 dB gain flatness. The LNA, power amplifier, radio frequency switches, and/or various functional analog/digital blocks may be monolithically integrated into a single SOI die.

A varying number of temperature regions may be used, which may affect gain flatness. For example, as the number of temperature regions increases (and the sizes of the temperature regions decrease), the overall gain flatness may increase. The current slope may be designed to achieve overall gain flatness and/or increase flatness in the middle of a temperature region. If only one current slope is used, gain values in the middle of one or more temperature regions may be relatively flat.

In some embodiments, the number of temperature regions may be proportional with the number of bits. For example, the number of temperature regions may be calculated using the equation $2^n$+2, where "n" is the number of bits. To maintain high digital-to-analog converter accuracy, the number of bits may be maintained below a threshold value. For example, only three bits or fewer may be used.

Figure 2:
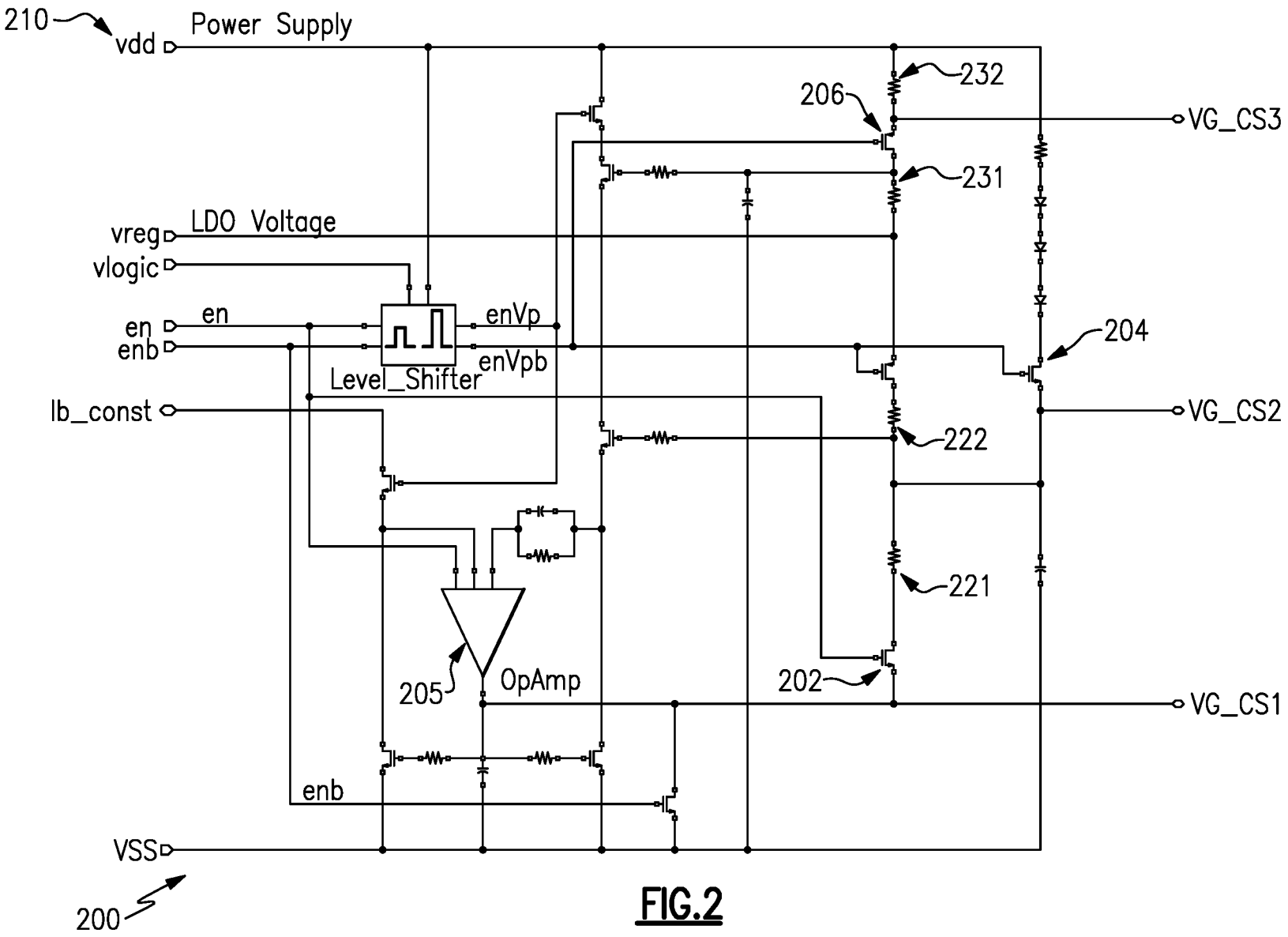
FIG. 2 depicts a block diagram of a bias voltage generator of a power amplifier having one or more features as described herein.

FIG. 2 depicts a block diagram of a bias voltage generator 200 of a power amplifier having one or more features as described herein. In some embodiments, the bias voltage generator 200 may comprise a second stage of the power amplifier. The bias voltage generator 200 may include a multi-stacked topology (e.g., a three-stack topology) that may be used for a power amplifier output stage. The output stage may be powered by a voltage source ("Vdd") 210 (e.g., in the range of 2 V to 5 V). Some field-effect transistors may have a relatively low nominal operating voltage (e.g., approximately 2.5 V, and/or a maximum of 2.75 V). Accordingly, the reliability for both on and off states of the power amplifier may be critical. The bias voltage generator includes a first resistor ("R21") 221, a second resistor ("R22") 222, a third resistor ("R31") 231, and a fourth resistor ("R32") 232.

When the power amplifier is turned on, an operational amplifier (OpAmp) 205, together with a replica of the power amplifier output stage, may set a first bias voltage ("VG_CS1") for a first field-effect transistor (FET) 202 to be approximately equal to an output voltage of the OpAmp 205. A second FET 204 in the output stage may provide a second bias voltage ("VG_CS2") that may be calculated as follows: VG_CS2=Vreg*R21/(R21+R22)+VG_CS1*R22/(R21+R22). A third FET 206 may be biased at a third bias voltage ("VG_CS3"), which may be calculated as follows: VG_CS3=VDD*R31/(R31+R32)+Vreg*R32/(R31+R32), where VDD 210 is the supply voltage. When the power amplifier is turned off, the first bias voltage may be approximately 0 V, the second bias voltage may equal to VDD−3*Vth,diode-Ileak*Rb1 (where "Vth,diode" is a diode forward conduction voltage and "Ileak" is leakage current), and the third bias voltage may be equal to VDD 210. Any high voltage shows in the drain of the third FET 206 may be divided by stacked FETs such that all FETs in the power amplifier output stage may be protected from high voltage stress in both on and off modes of the power amplifier.

The bias voltage generator 200 shown in FIG. 2 has a cascode structure and may provide multiple voltage output levels. In some embodiments, a first voltage level provided by the bias voltage generator 200 may be used during active (i.e., awake) states and a second voltage level may be used during sleep modes. The second voltage level may be relatively low (e.g., less than 1 V). In this way, the power amplifier may support a high current mirror ratio and may generate a high yield.

Figure 3:
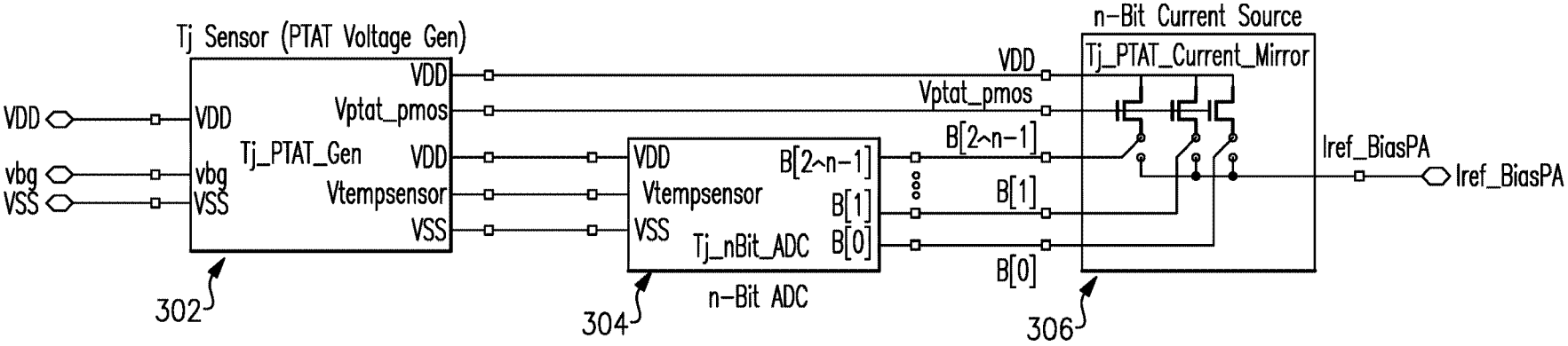
FIG. 3 depicts a block diagram of a biasing scheme for a monolithic integrated SOI CMOS high-power amplifier for providing superior small-signal gain flatness having one or more features as described herein.

FIG. 3 depicts a block diagram of a biasing scheme 300 for a monolithic integrated SOI CMOS high-power amplifier for providing superior small-signal gain flatness having one or more features as described herein. In some embodiments, the biasing scheme 300 may comprise three major blocks: a junction temperature (Tj) sensor 302 configured to detect the power amplifier Tj and convert the Tj value to an output voltage ("Vtempsensor") value; an n-bit analog-to-digital converter (ADC) 304 configured to convert the output voltage signal from the Tj sensor 302 into digital bits (e.g., n bits); and an n-bit current source 306 (e.g., a p-channel FET (PFET) current source) controlled by ADC 304 output digital bits to generate desired discrete reference current levels for specific Tj regions (e.g., $2^n$+2 regions).

The generated voltage may increase with increased junction temperature. In some embodiments, once a certain temperature level is reached (e.g., 50° C.), a signal indicated by the bits may change and/or a different circuit path may be activated.

Figure 4:
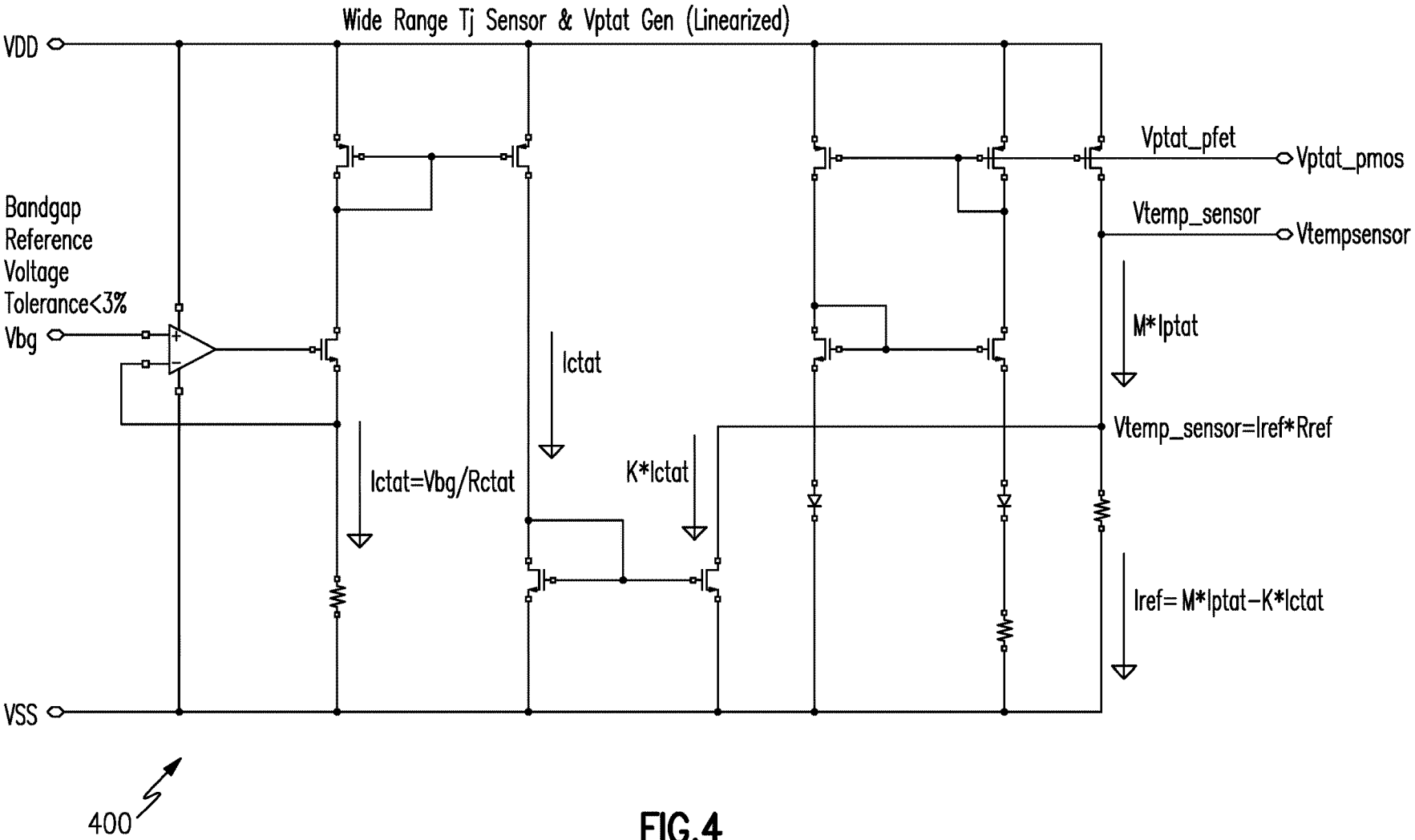
FIG. 4 depicts a schematic diagram of a wide linear-range PTAT-based junction temperature sensor having one or more features as described herein.

FIG. 4 depicts a schematic diagram of a wide linear-range PTAT-based junction temperature sensor 400 having one or more features as described herein. In some embodiments, the sensor 400 may be incorporated in an SOI CMOS power amplifier die (e.g., the front-end module 100 of FIG. 1). The sensor 400 may comprise a bandgap-core configured to generate a current ("Iptat") and a biasing gate voltage ("Vptat_pfet") to drive an n-bit ADC-controlled PFET current source. A bandgap voltage-based voltage-to-current converter (V2I) may be used to generate a constant current (e.g., a CTAT current ("ICTAT")), which may broaden the linear range of the sensor 400 operating temperature and/or voltage range.

Figure 5:
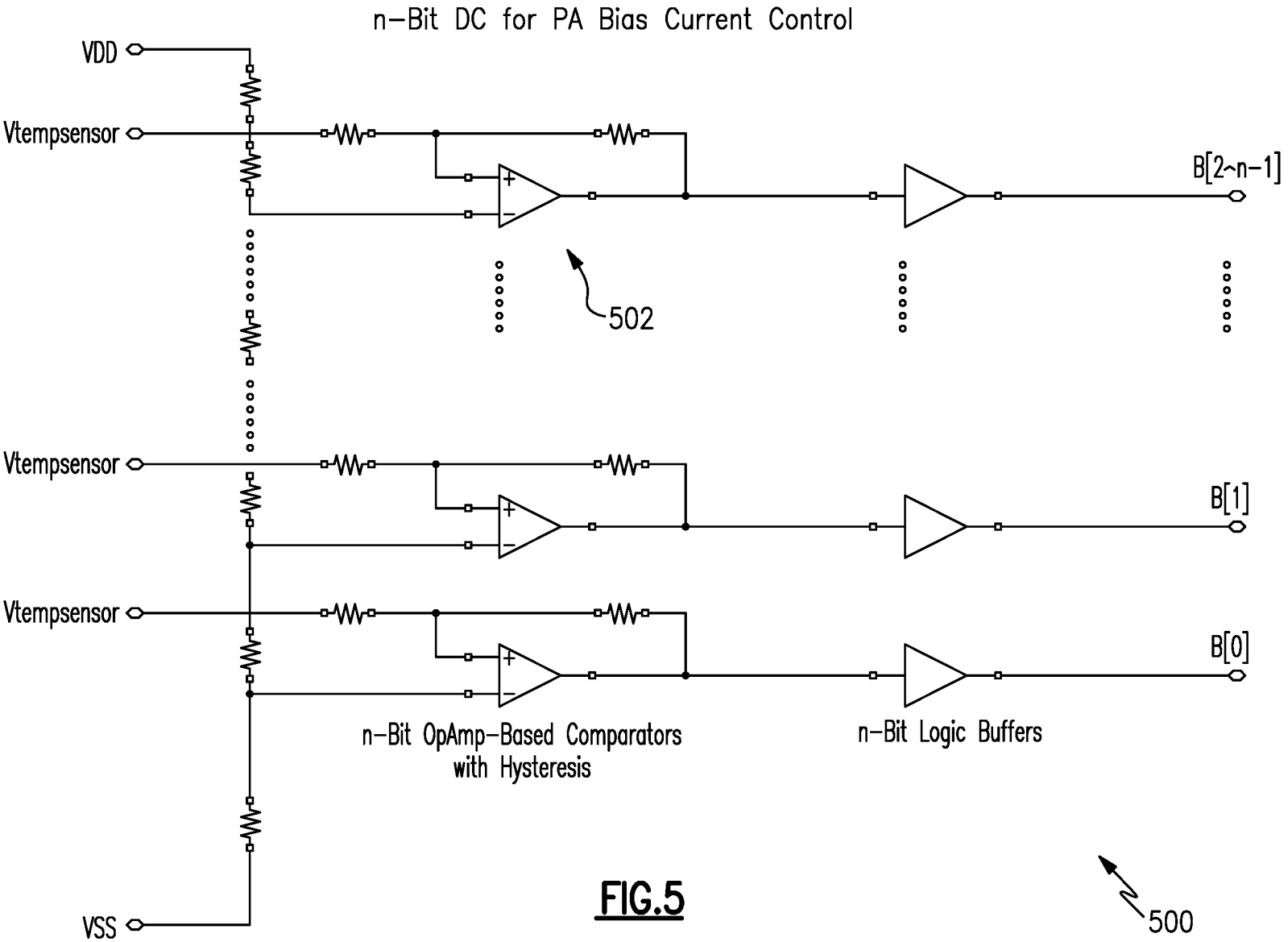
FIG. 5 depicts a schematic diagram of an n-bit ADC having one or more features as described herein.

FIG. 5 depicts a schematic diagram of an n-bit ADC 500 having one or more features as described herein. The ADC 500 may utilize wide-input range OpAmp-based comparators with optimized hysteresis. In some embodiments, the ADC 500 may be configured to convert a junction temperature sensor (e.g., the sensor 400 in FIG. 4) output voltage (e.g., Vptat) into digital bits. For example, the ADC 500 may be configured to convert an output voltage into $2^n$ digital bits (e.g., B[0], B[1], up to B[$2^n$−1]). The ADC 500 may be further configured to generate one or more reference voltages (e.g., Vref_0, Vref_1, . . . Vref_n) using one or more resistor-based voltage dividers. In some embodiments, the ADC 500 may be powered by a high-quality LDO regulator and/or may comprise well-matched poly-resistor unit cells. Accordingly, PVT variations of reference voltages for the ADC 500 may be negligible. Moreover, the ADC 500 may be configured to build a comparator bank 502 using a wide-input range and/or high-gain OpAmp together with a well-matched poly-resistor feedback network. Accordingly, PVT variations and/or mismatches may be minimized as much as possible.

Figure 6:
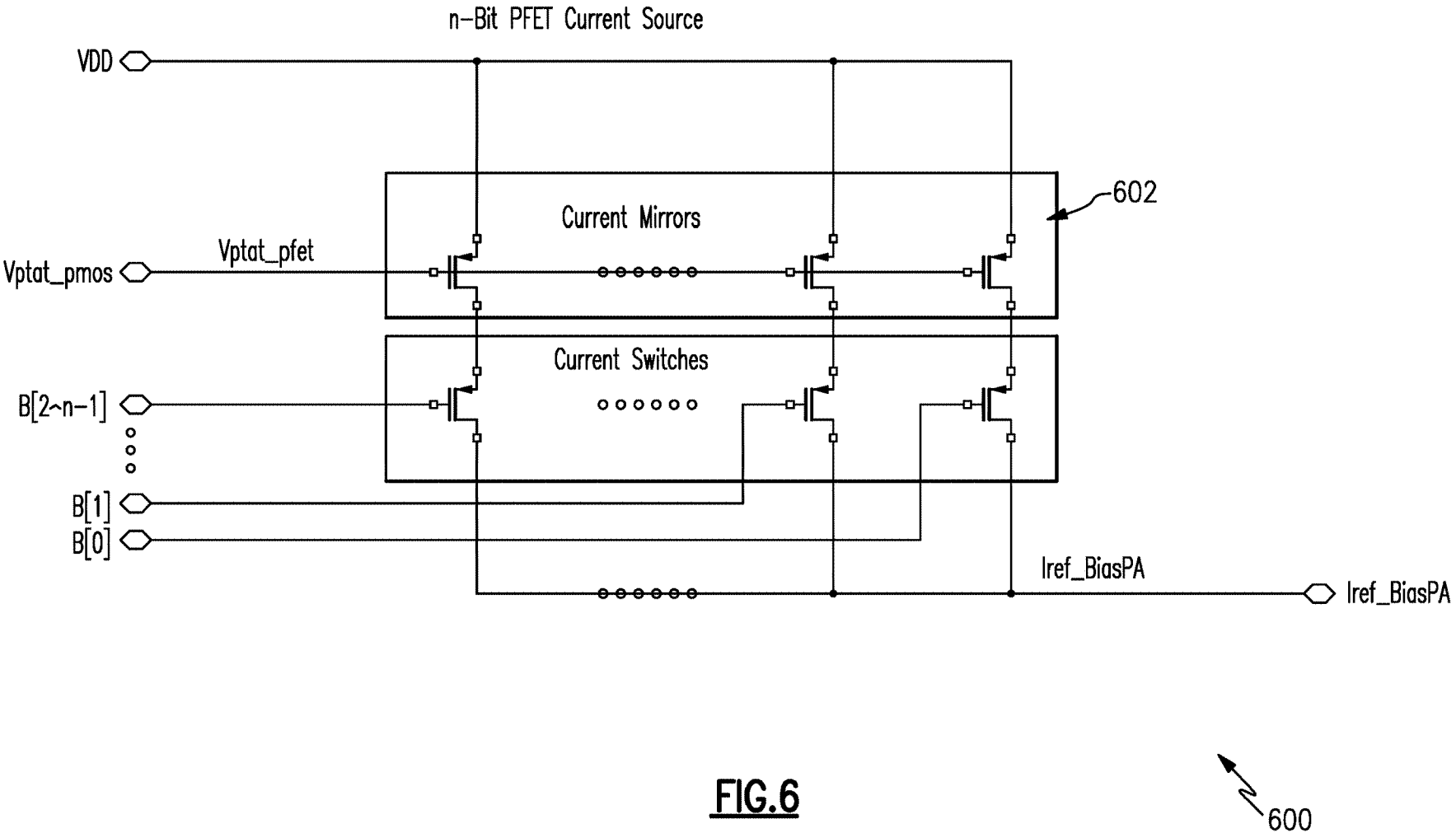
FIG. 6 depicts a schematic diagram of a current source having one or more features as described herein.

FIG. 6 depicts a schematic diagram of a current source 600 having one or more features as described herein. In some embodiments, the current source 600 may be configured to generate a reference current ("Iref_BiasPA") and/or bias current for a power amplifier. For example, the current source 600 may be configured to generate a reference current and/or a bias current for a first and/or second stage of a power amplifier. In some embodiments, the current source 600 may comprise an n-bit ADC-controlled PFET current source bank and/or may be configured to generate the reference current for an SOI CMOS power amplifier to achieve superior small-signal gain flatness. The current source 600 may comprise one or more current mirrors 602.

Figure 7:
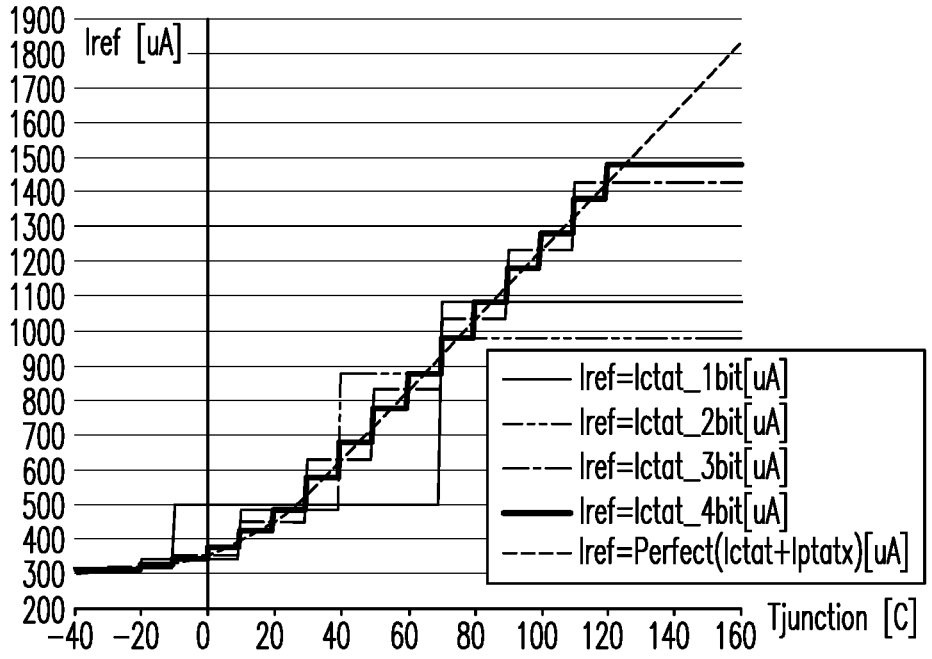
FIG. 7 shows a comparison of various n-bit reference currents to a non-linear (e.g., theoretical or target) current in accordance with some embodiments.

In some embodiments, a reference current for an SOI CMOS power amplifier may be a constant value. Such constant reference currents may be easier to design than non-linear current slopes and/or may be configured to provide very low quiescent collector current (Icq) PVT variations, higher yield, and/or greater reliability. FIG. 7 provides a comparison of various n-bit reference currents to a non-linear (e.g., theoretical or target) current. The more bits that are used, the closer a current slope can get to the target non-linear current slope. In some embodiments, a non-linear current slope may be configured to provide 0 dB variation. The reference current may be calculated as follows: $I_{ref}=I_{ctat}+I_{ptat}^{x}$. $I_{ptat}^{X}$ may be calculated as follows: $I_{ptat}^{x}=I_0+I_1(T_j)+I_2(T_j^2)+\ldots+I_n(T_j^n)$.

Figure 8:
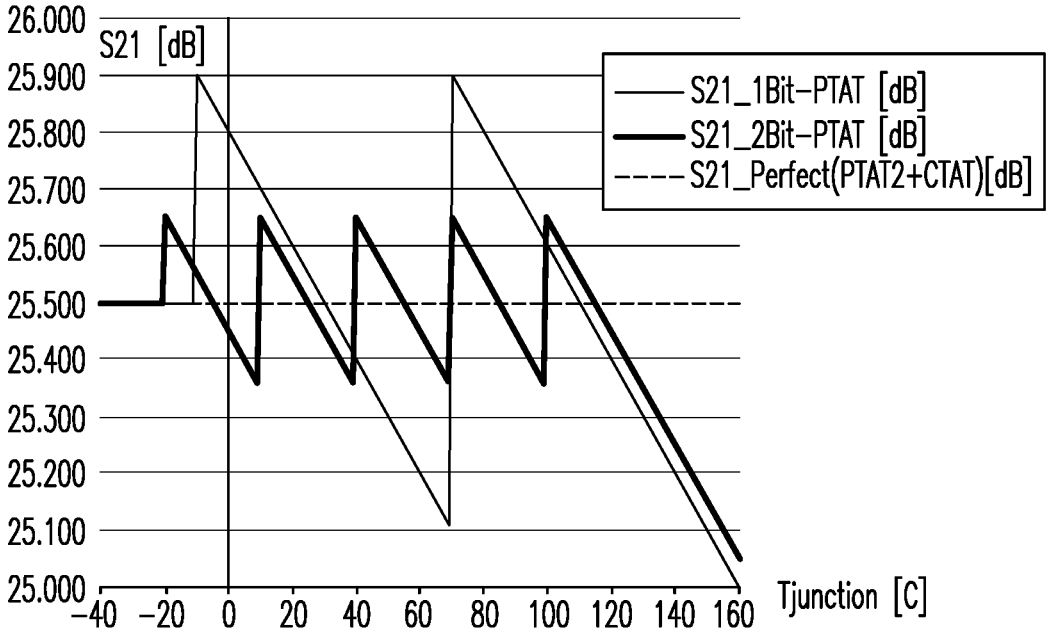
FIG. 8 illustrates a comparison graph of various n-bit current slopes compared to a target curve representing 0 dB gain flatness in accordance with some embodiments.

FIG. 8 illustrates a comparison graph of various n-bit current slopes compared to a target curve representing 0 dB gain flatness. Current slopes may be improved using the following formula: $I_{ref}=M\times I_{ptat}-I_{ctat}$, which may provide a wider Tj sensor operating range. A curve may become more flat with a smaller number of bits.

Figure 9:
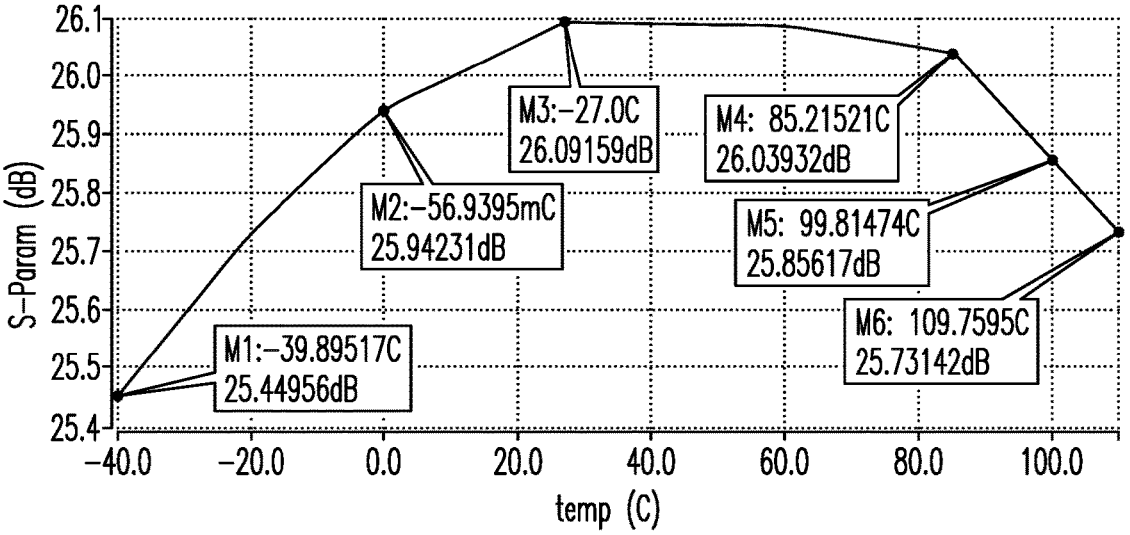
FIG. 9 shows a comparison graph of a target n-bit current slope to a higher-order temperature-compensated reference current in accordance with some embodiments.

FIG. 9 shows a comparison graph of a target n-bit current slope to a higher-order temperature-compensated reference current. In some embodiments, a reference current using a very small bit value ADC can effectively trace the target curve in each temperature region. The overall peak value of the curve may result in relatively high gain flatness in the center of each temperature region, as well as a relatively high overall gain flatness.

Figure 10:
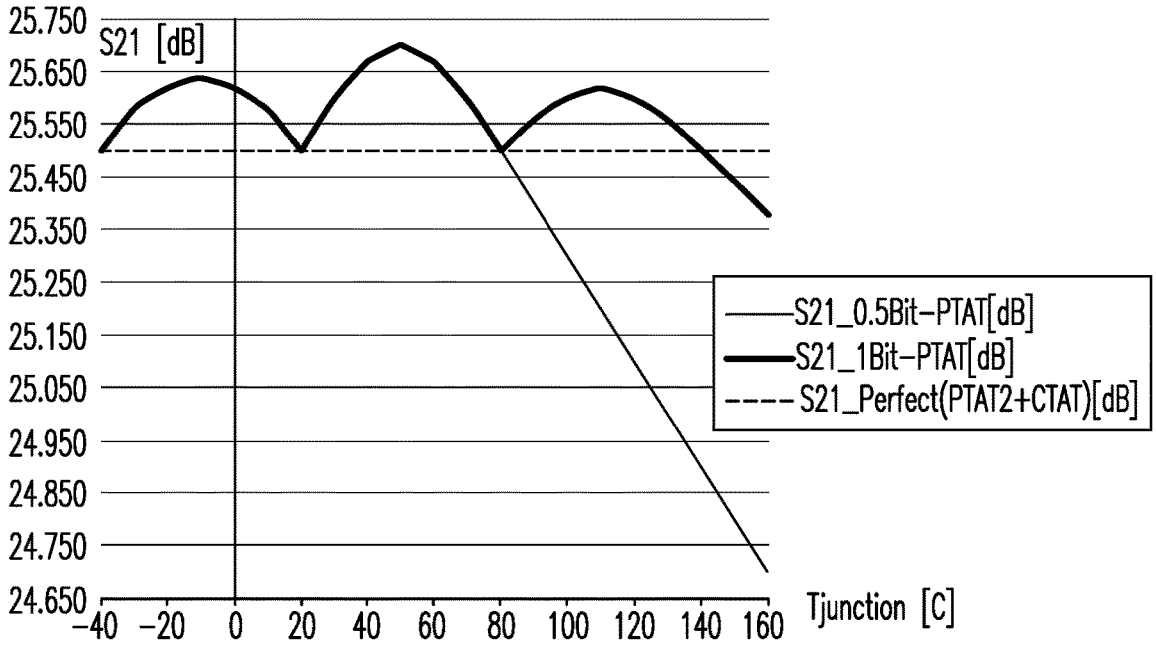
FIG. 10 shows reference currents providing less than 0.25 dB gain flatness from −40 to 125° C. for various n-bit PTAT devices in accordance with some embodiments.

FIG. 10 shows reference currents providing less than 0.25 dB gain flatness from −40 to 125° C. for various n-bit PTAT devices. In some embodiments, a 1-bit junction temperature sharper-slope voltage reference may be used.

In some embodiments, a front-end module having one or more features as described herein can be implemented in different products, including those examples provided herein. Such products can include, or be associated with, any front-end system or module in which power amplification is desired. Such a front-end module or system can be configured to support wireless operations involving, for example, cellular devices, WLAN devices, IoT devices, etc.

Figure 11:
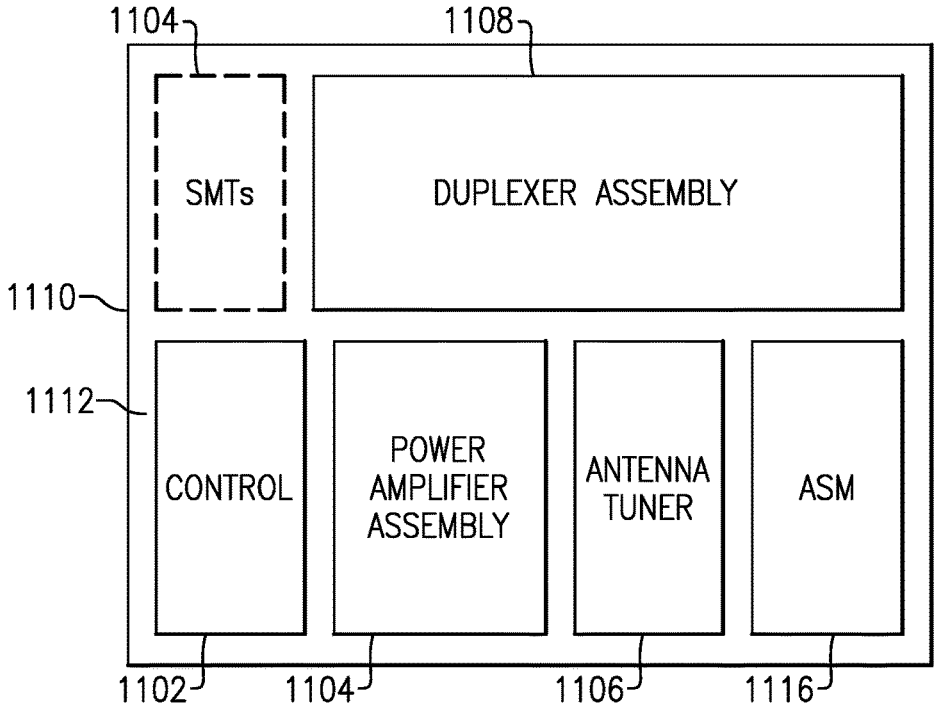
FIG. 11 shows a module including some or all of a front-end architecture having one or more features as described herein.

FIG. 11 shows that in some embodiments, some or all of a front-end architecture having one or more features as described herein can be implemented in a module. Such a module can be, for example, a front-end module (FEM). In the example of FIG. 11, a module 1110 can include a packaging substrate 1112, and a number of components can be mounted on such a packaging substrate. For example, a control component 1102, a power amplifier assembly 1104, an antenna tuner component 1106, and a duplexer assembly 1108 can be mounted and/or implemented on and/or within the packaging substrate 1112. Other components such as a number of SMT devices 1104 and an antenna switch module (ASM) 1116 can also be mounted on the packaging substrate 1112. Although all of the various components are depicted as being laid out on the packaging substrate 1112, it will be understood that some component(s) can be implemented over other component(s).

In some implementations, a device and/or a circuit having one or more features described herein can be included in an RF device such as a wireless device. Such a device and/or a circuit can be implemented directly in the wireless device, in a modular form as described herein, or in some combination thereof. In some embodiments, such a wireless device can include, for example, a cellular phone, a smart-phone, a hand-held wireless device with or without phone functionality, a wireless tablet, etc.

Figure 12:
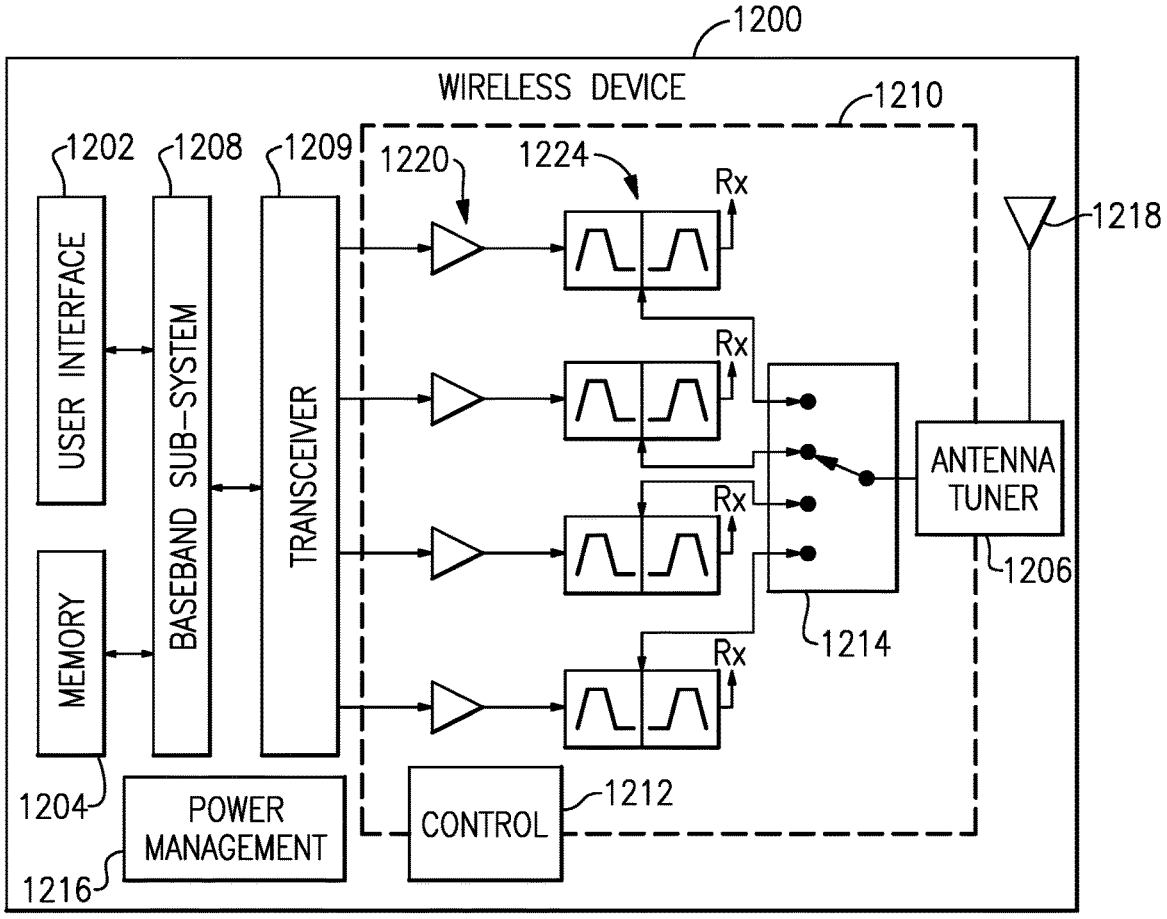
FIG. 12 depicts an example wireless device having one or more advantageous features described herein.

FIG. 12 depicts an example wireless device 1200 having one or more advantageous features described herein. In the context of a module having one or more features as described herein, such a module can be generally depicted by a dashed box 1210, and can be implemented as, for example, a front-end module (FEM).

Referring to FIG. 12, power amplifiers 1220 can receive their respective RF signals from a transceiver 1209 that can be configured and operated in known manners to generate RF signals to be amplified and transmitted, and to process received signals. The transceiver 1209 is shown to interact with a baseband sub-system 1208 that is configured to provide conversion between data and/or voice signals suitable for a user and RF signals suitable for the transceiver 1209. The transceiver 1209 can also be in communication with a power management component 1216 that is configured to manage power for the operation of the wireless device 1200. Such power management can also control operations of the baseband sub-system 1208 and the module 1210.

The baseband sub-system 1208 is shown to be connected to a user interface 1202 to facilitate various input and output of voice and/or data provided to and received from the user. The baseband sub-system 1208 can also be connected to a memory 1204 that is configured to store data and/or instructions to facilitate the operation of the wireless device, and/or to provide storage of information for the user.

In the example wireless device 1200, outputs of the PAs 1220 are shown to be routed to their respective duplexers 1220. Such amplified and filtered signals can be routed to an antenna 1218 through an antenna switch 1214 for transmission. In some embodiments, the duplexers 1220 can allow transmit and receive operations to be performed simultaneously using a common antenna (e.g., 1218). In FIG. 12, received signals are shown to be routed to "Rx" paths (not shown) that can include, for example, a low-noise amplifier (LNA).

As described herein, one or more features of the present disclosure can provide a number of advantages when implemented in systems such as those involving the wireless device of FIG. 12. For example, a controller 1212, which may or may not be part of the module 1210, can monitor base currents associated with at least some of the power amplifiers 1220. Based on such monitored base currents, an antenna tuner 1206 (which may or may not be part of the module 1210), can be adjusted to provide a desired impedance to the corresponding power amplifier.

The present disclosure describes various features, no single one of which is solely responsible for the benefits described herein. It will be understood that various features described herein may be combined, modified, or omitted, as would be apparent to one of ordinary skill. Other combinations and sub-combinations than those specifically described herein will be apparent to one of ordinary skill, and are intended to form a part of this disclosure. Various methods are described herein in connection with various flowchart steps and/or phases. It will be understood that in many cases, certain steps and/or phases may be combined together such that multiple steps and/or phases shown in the flowcharts can be performed as a single step and/or phase. Also, certain steps and/or phases can be broken into additional sub-components to be performed separately. In some instances, the order of the steps and/or phases can be rearranged and certain steps and/or phases may be omitted entirely. Also, the methods described herein are to be understood to be open-ended, such that additional steps and/or phases to those shown and described herein can also be performed.

Some aspects of the systems and methods described herein can advantageously be implemented using, for example, computer software, hardware, firmware, or any combination of computer software, hardware, and firmware. Computer software can comprise computer executable code stored in a computer readable medium (e.g., non-transitory computer readable medium) that, when executed, performs the functions described herein. In some embodiments, computer-executable code is executed by one or more general purpose computer processors. A skilled artisan will appreciate, in light of this disclosure, that any feature or function that can be implemented using software to be executed on a general purpose computer can also be implemented using a different combination of hardware, software, or firmware. For example, such a module can be implemented completely in hardware using a combination of integrated circuits. Alternatively or additionally, such a feature or function can be implemented completely or partially using specialized computers designed to perform the particular functions described herein rather than by general purpose computers.

Multiple distributed computing devices can be substituted for any one computing device described herein. In such distributed embodiments, the functions of the one computing device are distributed (e.g., over a network) such that some functions are performed on each of the distributed computing devices.

Some embodiments may be described with reference to equations, algorithms, and/or flowchart illustrations. These methods may be implemented using computer program instructions executable on one or more computers. These methods may also be implemented as computer program products either separately, or as a component of an apparatus or system. In this regard, each equation, algorithm, block, or step of a flowchart, and combinations thereof, may be implemented by hardware, firmware, and/or software including one or more computer program instructions embodied in computer-readable program code logic. As will be appreciated, any such computer program instructions may be loaded onto one or more computers, including without limitation a general purpose computer or special purpose computer, or other programmable processing apparatus to produce a machine, such that the computer program instructions which execute on the computer(s) or other programmable processing device(s) implement the functions specified in the equations, algorithms, and/or flowcharts. It will also be understood that each equation, algorithm, and/or block in flowchart illustrations, and combinations thereof, may be implemented by special purpose hardware-based computer systems which perform the specified functions or steps, or combinations of special purpose hardware and computer-readable program code logic means.

Furthermore, computer program instructions, such as embodied in computer-readable program code logic, may also be stored in a computer readable memory (e.g., a non-transitory computer readable medium) that can direct one or more computers or other programmable processing devices to function in a particular manner, such that the instructions stored in the computer-readable memory implement the function(s) specified in the block(s) of the flowchart(s). The computer program instructions may also be loaded onto one or more computers or other programmable computing devices to cause a series of operational steps to be performed on the one or more computers or other programmable computing devices to produce a computer-implemented process such that the instructions which execute on the computer or other programmable processing apparatus provide steps for implementing the functions specified in the equation(s), algorithm(s), and/or block(s) of the flowchart(s).

Some or all of the methods and tasks described herein may be performed and fully automated by a computer system. The computer system may, in some cases, include multiple distinct computers or computing devices (e.g., physical servers, workstations, storage arrays, etc.) that communicate and interoperate over a network to perform the described functions. Each such computing device typically includes a processor (or multiple processors) that executes program instructions or modules stored in a memory or other non-transitory computer-readable storage medium or device. The various functions disclosed herein may be embodied in such program instructions, although some or all of the disclosed functions may alternatively be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list. The word "exemplary" is used exclusively herein to mean "serving as an example, instance, or illustration." Any implementation described herein as "exemplary" is not necessarily to be construed as preferred or advantageous over other implementations.

The disclosure is not intended to be limited to the implementations shown herein. Various modifications to the implementations described in this disclosure may be readily apparent to those skilled in the art, and the generic principles defined herein may be applied to other implementations without departing from the spirit or scope of this disclosure. The teachings of the invention provided herein can be applied to other methods and systems, and are not limited to the methods and systems described above, and elements and acts of the various embodiments described above can be combined to provide further embodiments. Accordingly, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A front-end module comprising:

a low-dropout (LDO) voltage regulator;

a power amplifier; and a reference current generator directly connected to the LDO voltage regulator and the power amplifier, the reference current generator comprising a junction temperature sensor configured to detect a junction temperature value of the power amplifier and convert the junction temperature value to an output voltage value, an n-bit analog-to-digital converter configured to convert the output voltage value into digital bits, and a current source configured to generate discrete reference current levels for specific junction temperature regions based on the digital bits;

the LDO voltage regulator, reference current generator, and power amplifier being integrated on a first semiconductor die.

2. The front-end module of claim 1 further comprising a logic level slicer directly connected to the LDO voltage regulator and the reference current generator and configured to convert multiple logic levels to a single logic level.

3. The front-end module of claim 2 further comprising a logic decoder directly connected to an output of the logic level slicer and an output of the LDO voltage regulator.

4. The front-end module of claim 3 further comprising a level shifter directly connected to an output of the logic decoder.

5. The front-end module of claim 1 wherein the power amplifier comprises three or more field-effect transistors and wherein the power amplifier is configured to generate three or more different bias voltages.

6. The front-end module of claim 1 further comprising a mode detector integrated on the first semiconductor die.

7. The front-end module of claim 6 wherein the mode detector is configured to generate a power-down signal to power down the LDO voltage regulator.

8. The front-end module of claim 1 further comprising a voltage reference integrated on the first semiconductor die.

9. The front-end module of claim 8 wherein the voltage reference is configured to provide a reference voltage to the LDO voltage regulator and the reference current generator.

10. The front-end module of claim 1 wherein the power amplifier is configured to operate at a first level during transmit modes and operate at a second level during non-transmit modes.

11. A semiconductor die comprising:

a substrate;

a low-dropout (LDO) voltage regulator;

a power amplifier; and a reference current generator directly connected to the LDO voltage regulator and the power amplifier, the reference current generator comprising a junction temperature sensor configured to detect a junction temperature value of the power amplifier and convert the junction temperature value to an output voltage value, an n-bit analog-to-digital converter configured to convert the output voltage value into digital bits, and a current source configured to generate discrete reference current levels for specific junction temperature regions based on the digital bits.

12. The semiconductor die of claim 11 further comprising a logic level slicer directly connected to the LDO voltage regulator and the reference current generator and configured to convert multiple logic levels to a single logic level.

13. The semiconductor die of claim 12 further comprising a logic decoder directly connected to an output of the logic level slicer and an output of the LDO voltage regulator.

14. The semiconductor die of claim 13 further comprising a level shifter directly connected to an output of the logic decoder.

15. The semiconductor die of claim 11 wherein the power amplifier comprises three or more field-effect transistors and wherein the power amplifier is configured to generate three or more different bias voltages.

16. The semiconductor die of claim 11 further comprising a mode detector.

17. The semiconductor die of claim 16 wherein the mode detector is configured to generate a power-down signal to power down the LDO voltage regulator.

18. The semiconductor die of claim 11 further comprising a voltage reference.

19. The semiconductor die of claim 18 wherein the voltage reference is configured to provide a reference voltage to the LDO voltage regulator and the reference current generator.

20. The semiconductor die of claim 11 wherein the power amplifier is configured to operate at a first level during transmit modes and operate at a second level during non-transmit modes.

* * * * *